US007669420B2

(12) United States Patent
Spooner

(10) Patent No.: US 7,669,420 B2
(45) Date of Patent: Mar. 2, 2010

(54) FUEL INJECTOR HAVING AN ANNULAR PREFILMER

(75) Inventor: Michael P. Spooner, Derby (GB)

(73) Assignee: Rolls-Royce plc, London (GB)

( * ) Notice: Subject to any disclaimer, the term of this patent is extended or adjusted under 35 U.S.C. 154(b) by 716 days.

(21) Appl. No.: 11/482,718

(22) Filed: Jul. 10, 2006

(65) Prior Publication Data

US 2007/0028619 A1 Feb. 8, 2007

(30) Foreign Application Priority Data

Aug. 5, 2005 (GB) ..... 0516208.6

(51) Int. Cl.
*F02C 1/00* (2006.01)
*F02G 3/00* (2006.01)

(52) U.S. Cl. ..... 60/743

(58) Field of Classification Search ..... 60/743, 60/748, 740, 737, 747

See application file for complete search history.

(56) References Cited

U.S. PATENT DOCUMENTS

| | | | | |
|---|---|---|---|---|
| 5,329,760 | A * | 7/1994 | Bradley et al. | 60/779 |
| 6,073,436 | A | 6/2000 | Bell et al. | |
| 6,898,938 | B2 | 5/2005 | Mancini et al. | |
| 2002/0011064 | A1 * | 1/2002 | Crocker et al. | 60/39.06 |
| 2004/0148938 | A1 | 8/2004 | Mancini et al. | |
| 2004/0250547 | A1 * | 12/2004 | Mancini et al. | 60/740 |

* cited by examiner

*Primary Examiner*—Michael Cuff
*Assistant Examiner*—Andrew Nguyen
(74) *Attorney, Agent, or Firm*—Oliff & Berridge, PLC

(57) ABSTRACT

A fuel injector for a gas turbine engine has a swirl slot that supplies fuel to a prefilmer. The swirl slot has an upstream lip and a downstream lip that are arranged eccentrically. The slot is thus provided with an area of high static pressure and an area of low static pressure caused by the flowing over the eccentrically arranged lips.

11 Claims, 7 Drawing Sheets

FUEL INJECTOR HAVING AN ANNULAR PREFILMER

This invention concerns fuel injectors and in particular fuel injectors for a gas turbine engine.

In an effort to reduce emissions and improve performance modern combustors are provided with staged fuel injectors. These injectors have a pilot injector (normally mounted on the axis of the injector) and a main injector mounted around and co axially with the pilot injector.

Efficiency is improved as at a low power requirement it is possible to switch off the fuel flow from the main injector. The pilot injector maintains a stable flame in these situations. At high power conditions fuel is supplied through the main injector in addition to the pilot injector. Typically the quantity of fuel supplied by the main injector is greater than the quantity of fuel supplied through the pilot.

Either or both of the pilot injector or main injector can be an airblast injector. In this type of injector fuel is supplied to a surface (known as a prefilmer) as a thin film. Air from a compressor upstream of the injector passes over the prefilmer at a relatively high velocity and atomises the film of fuel.

One problem that should be avoided in the operation of fuel injectors is that of coking. Coking occurs when fuel on a wetted surface is broken down into solid deposits. This typically happens when the fuel wetted surface is subjected to a temperature above 200° C. and below 450° C. at which point the coked fuel is burnt off.

Whilst fuel flows over the surface of the prefilmer there is little danger of coking occurring as the fuel itself acts as a coolant and keeps the prefilmer at a temperature lower than that at which coking occurs.

However, when the fuel flow to the main injector is turned off, either during low power requirements or during shut down, the temperature of the prefilmer and the fuel supply circuits to the prefilmer can quickly rise. Consequently, the temperature of residual fuel on the prefilmer or within the fuel supply circuits can also quickly rise to the temperature at which coking occurs. The coking can block the injectors and pipes rendering them inefficient or inoperable.

This is a problem that may also be observed with the pilot injector during engine shut down.

Consequently, a purging system is provided to empty the pipes of fuel. US 2004/0148938 describes one form of purging system. Fuel is supplied to a prefilmer through a plurality of circumferentially spaced spray wells that are asymmetrically flared out with respect to the a spray well centreline in different local streamwise directions. Some of the spray well surfaces may be asymmetrically flared out in a local upstream direction and others in a local downstream direction. The asymmetric flaring creates different static pressures at the spray wells that will drive stagnant fuel from the higher static pressure field holes syphonically up the feed arm, through a valve and down a second feed arm to the low static pressure field holes where the fuel is ejected into the air flow.

Whilst this structure serves to automatically purge stagnant fuel from the injector and feed arms, the small feed wells are sensitive to blockage, which may cause emission deterioration. The small wells must be formed individually and this can increase the manufacturing complexity and time for manufacture. Additionally, a complex valve and feed tube arrangement is required to control the heat transfer from hot compressor gas circulating through the main fuel circuit. The valve adds cost, weight and complexity to the engine and a failure in operation can be potentially dangerous.

There is a need for an improved fuel injector that seeks to provide improved purging.

Therefore, in accordance with the present invention there is provided: a fuel injector for a gas turbine engine, having: a prefilmer having an first surface and a second surface, the first surface and the second surface being separated by an annular swirl slot for the supply of fuel to the second surface; wherein the first surface and second surface are arranged such that, in use, a flow of fluid over the prefilmer creates a static pressure within the swirl slot that has varies over the length of the swirl slot.

Preferably the length of the swirl slot is divided into at least two sub-lengths, wherein the static pressure over a first sub-length of the swirl slot is greater than the static pressure over a second sub-length of the swirl slot.

The static pressure over the first sub-length and/or second sub-length may be is constant.

Preferably, along the first sub-length of the swirl slot, the second surface of the prefilmer is located radially inside the plane of the first surface, if that plane was extended axially rearwards. Along the second sub-length of the swirl slot, the second surface of the prefilmer may be located radially outside the plane of the first surface, if that plane was extended axially rearwards.

The first surface preferably has an annular lip that forms an first edge of the swirl slot and the second surface has an annular lip that forms a second edge of the swirl slot.

The first edge and the second edge may be eccentric.

Preferably, in use, the fluid flowing over the prefilmer to generate the static pressure in the swirl slot is air. Preferably, the first surface is an upstream surface and the second surface is a downstream surface.

Preferably the fuel injector according has a fuel manifold for supplying fuel to the swirl slot. Preferably the fuel manifold divides to, when fuel is being supplied to the downstream surface of the prefilmer, simultaneously supply fuel to the first sub-length and the second sub-length of the swirl slot.

According to a second embodiment of the invention there is provided a fuel injection system for a gas turbine engine comprising:

a shaft;

a injector head mounted to the end of the shaft and having a pilot injector for the injection of pilot fuel into a combustion chamber, and a main injector for the injection of main fuel into the combustion chamber;

a pilot fuel supply conduit for the supply of fuel to the pilot injector; and a main fuel supply for the intermittent supply of fuel to the main injector;

wherein the main fuel supply has a first section which retains fuel when the supply of fuel to the main injector is interrupted in use and a second section which is purged of fuel when the supply of fuel to the main injector is interrupted in use; and wherein the fuel retained in the first section is cooled by the pilot fuel supply conduit.

Preferably, within a period of interrupted flow, the second section comprises a passage having at one end a termination within area of relatively high static pressure and at a second end a termination within an area of relatively low static pressure.

An interface between the first section the second section may be located towards the end of the shaft adjacent the head.

Preferably, the pilot fuel supply conduit is not is not in substantial thermal contact with the second section of the main fuel supply conduit.

The fuel injector or fuel injection system according to the invention may be incorporated in a combustion chamber and/or a gas turbine engine.

Embodiments of the present invention will now be described by way of example only and with reference to the accompanying drawings, in which:—

Figure 1:
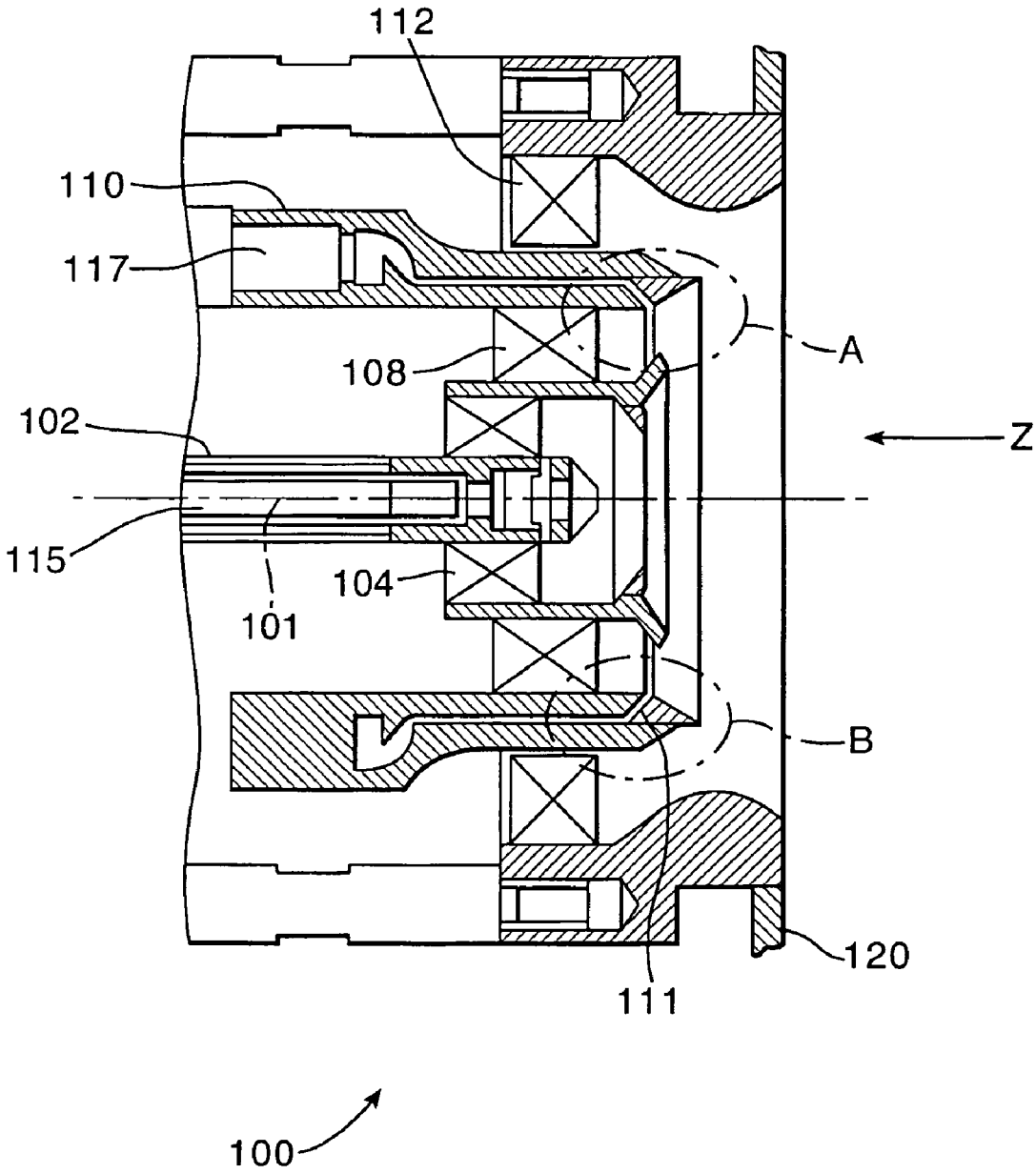
FIG. 1 is a cross-sectional schematic view of a piloted airblast fuel injector system.

FIG. 1 shows a cross-sectional schematic view of a piloted airblast fuel injector system 100. The piloted airblast fuel injector system 100 includes three air passages and two fuel injectors. The piloted airblast fuel injector system 100 is mounted upon the dome wall 120 of a combustor of a gas turbine engine.

In the exemplary embodiment of FIG. 1, the piloted airblast fuel injector system 100 includes a pilot fuel injector 102 located on the centerline 101 of the piloted airblast fuel injector system 100. A pilot swirler 104, used to swirl air past the pilot fuel injector 102, surrounds the pilot fuel injector 102. The pilot swirler 104 shown in the exemplary embodiment is an axial type pilot swirler. In general, the pilot swirler 104, and any of the other swirlers, can be either radial or axial swirlers, and may be designed to have a vane-like configuration.

The piloted airblast fuel injector system 100 utilizes a pilot fuel injector 102 of the type commonly referred to as a simplex pressure atomizer fuel injector. As will be understood by those skilled in the art, the simplex pressure atomizer fuel injector 102 atomizes fuel based upon a pressure differential placed across the fuel, rather than atomizing fuel with a rapidly moving air stream as do airblast atomizers.

The piloted airblast fuel injector system 100 further includes a main airblast fuel injector 110 which is concentrically located about the simplex pressure atomizer pilot fuel injector 102. Inner and outer main swirlers 108 and 112 are located concentrically inward and outward of the main airblast fuel injector 110. The simplex pressure atomizer pilot fuel injector 102 and main fuel injector 110 may also be described as a primary fuel injector 102 and a secondary fuel injector 110, respectively.

As it will be appreciated by those skilled in the art, the main airblast fuel injector 110 provides liquid fuel to an annular aft end 111 which allows the fuel to flow in an annular film. The annular film of liquid fuel is then entrained in the much more rapidly moving and swirling air streams passing through inner main swirler 108 and outer main swirler 112, which air streams cause the annular film of liquid fuel to be atomized into small droplets. Preferably, the design of the airblast main fuel injector 110 is such that the main fuel is entrained approximately mid-stream between the air streams exiting the inner main swirler 108 and the outer main swirler 112. The inner and outer main swirlers 108 and 112 have a vane configuration, the vane angles of the outer main swirler 112 may be either counter-swirl or co-swirl with reference to the vane angles of the inner main swirler 108.

Figure 2:
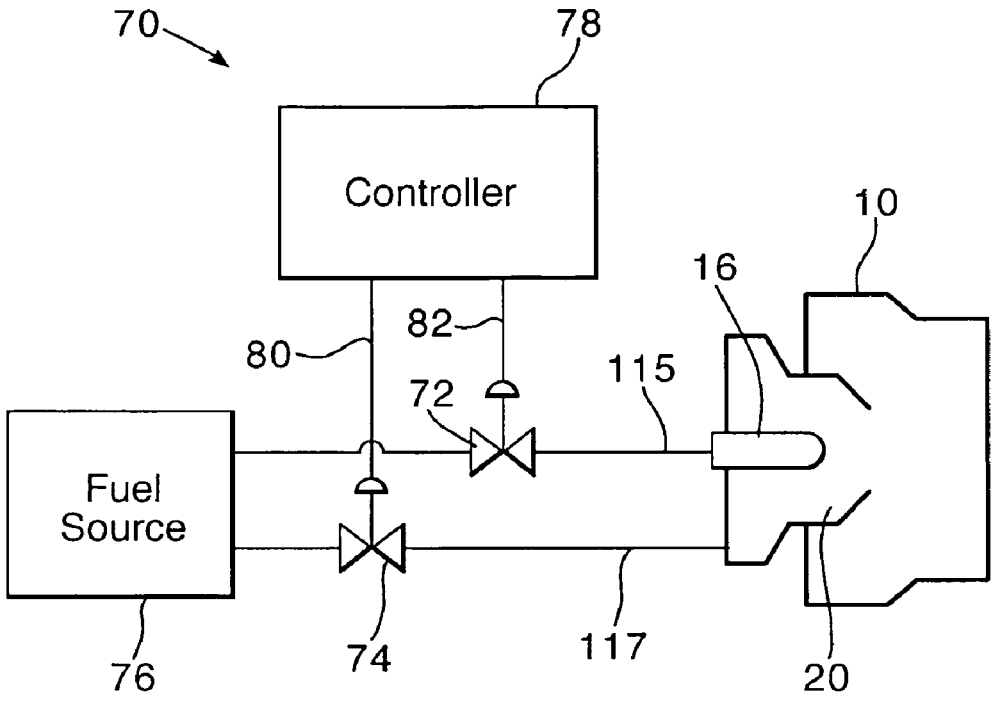
FIG. 2 is schematic of a fuel supply system for the injector of FIG. 1.

FIG. 2 schematically illustrates a fuel supply control system 70 utilized with the fuel injector like the fuel injector system 100 of FIG. 1. The fuel supply control system 70 includes control valves 72 and 74 disposed in the pilot and main fuel supply lines 115 and 117, which supply lines lead from a fuel source 76. A microprocessor based controller 78 sends control signals over communication lines 80 and 82 to the control valves 72 and 74 to control the flow of fuel to pilot fuel injector 102 and main fuel injector 110 in response to various inputs to the controller and to the pre-programmed instructions contained in the controller. In general, during low power operation of the gas turbine associated with the fuel injection system 100, fuel will be directed only to the pilot fuel injector 102, and at higher power operating conditions, fuel will be provided both to the pilot fuel injector 102 and the main airblast fuel injector 110.

During low power operation of the fuel injector 100, fuel is provided only to the pilot fuel injector 102 via the pilot fuel supply line 115. The fuel is atomized into the small droplets.

At higher power operation of the fuel injector 100, fuel is also injected into the main airblast injector 110 via the main fuel line 117. The main fuel droplets 113 are entrained within the air flow between air stream lines of the outer and inner main swirlers 108 and 112.

Figure 3:
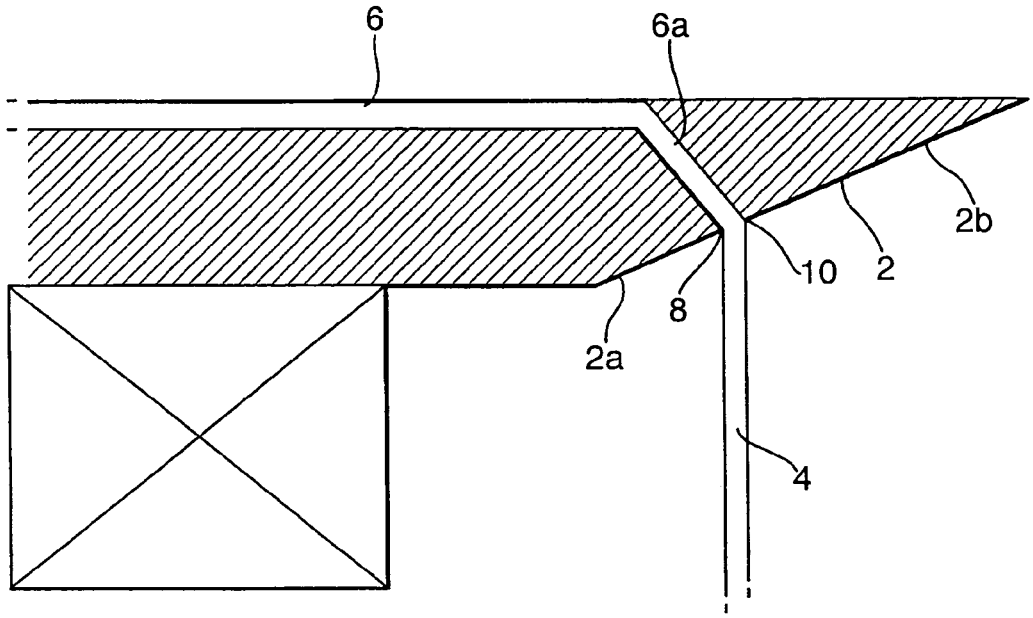
FIG. 3 is a expanded view of the prefilmer within A of FIG. 1.
Figure 4:
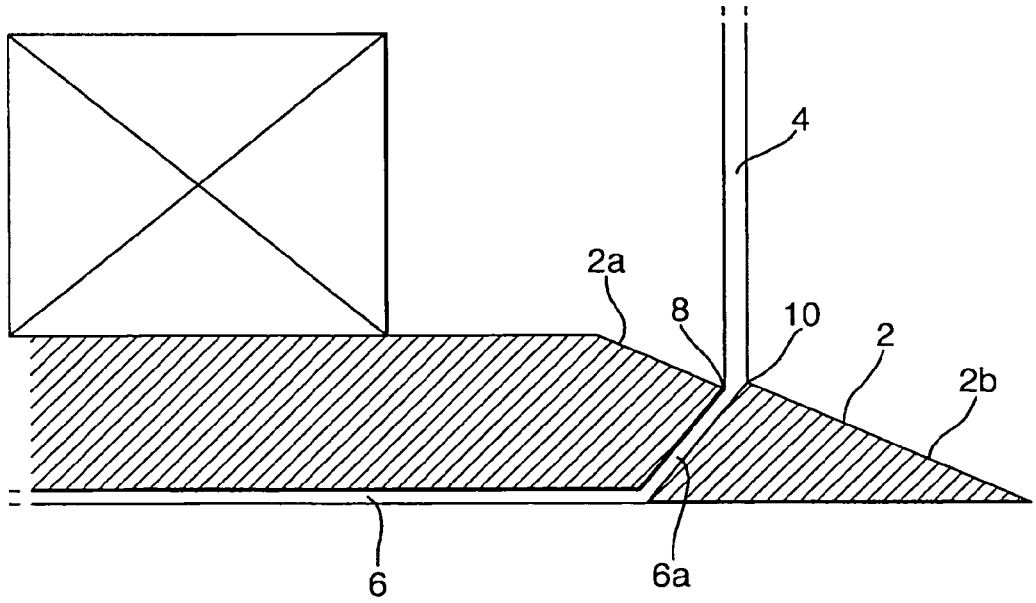
FIG. 4 is a expanded view of the prefilmer within B of FIG. 1.

FIG. 3 and FIG. 4 are enlarged views of the sections A and B respectively of FIG. 1 and depicts a low static pressure point and high static pressure point respectively of the swirl slot. The prefilmer 2 onto which the fuel is fed has a radially outward slope as the prefilmer extends axially rearward. The swirl slot 4 extends circumferentially around the prefilmer such that fuel may be supplied to the prefilmer from any point along the swirl slot.

Fuel is fed to the swirl slot via an axially extending conduit 6 that is provided with a number of radially inwardly extending manifolds 6*a* that supply the swirl slots with fuel at a number circumferential points.

The prefilmer 2 has an upstream first surface 2*a* and a downstream second surface 2*b* the upstream surface and downstream surface being separated by the swirl slot 4. The upstream surface has a lip 8 that forms an upstream edge to the swirl slot 4. The downstream surface has a lip 10 that forms a downstream edge to the swirl slot 4. The upstream annular lip and downstream annular lip are eccentric.

At the region of the injector corresponding to FIG. 3 there is an out-of-wind step in that the downstream surface of the prefilmer is located radially outside the line of the upstream surface if that was extended axially rearwards beyond the swirl slot and at the same angle relative to the axis 101 of the injector.

The out-of-wind step creates an area of low static pressure immediately behind the upstream or first lip.

At the region of the injector corresponding to FIG. 4 there is an into-wind step in that the downstream surface of the prefilmer is located radially inside the line of the upstream surface if the upstream surface was extended axially rearwards beyond the swirl slot and at the same angle relative to the axis 101 of the injector.

The into-wind step creates an area of high static pressure immediately before the downstream lip.

Figure 5:
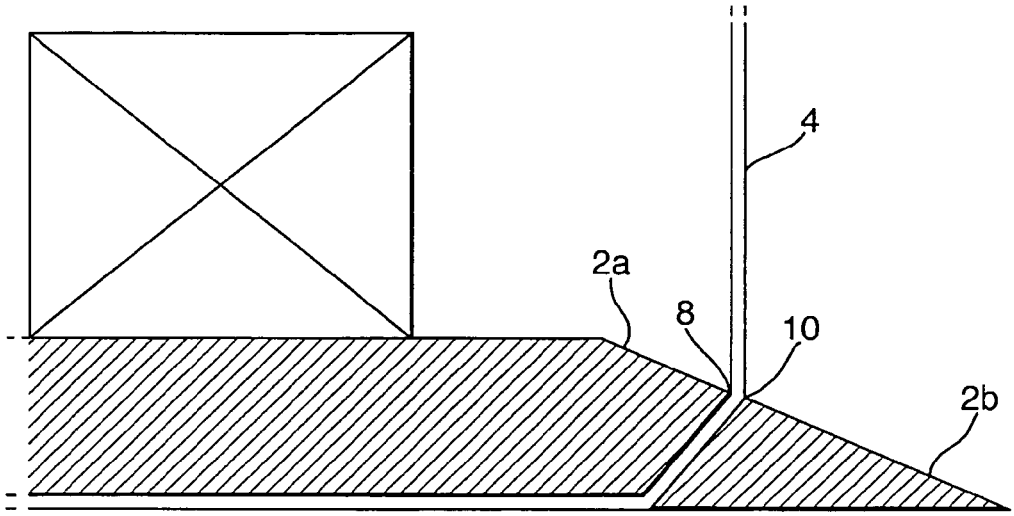
FIG. 5 is an expanded view of the prefilmer at point C of FIG. 6.

At the region of the injector corresponding to FIG. 5 there is neither an into-wind step nor an out-of-wind step in that the downstream surface of the prefilmer is substantially on the line of the upstream surface if the upstream surface was extended axially rearwards beyond the swirl slot and at the same angle relative to the axis 101 of the injector.

Thus, an area of static pressure at the swirl slot is created that is substantially neutral. Such an area of neutral static pressure is observed at points C and E of FIG. 6.

Figure 6:
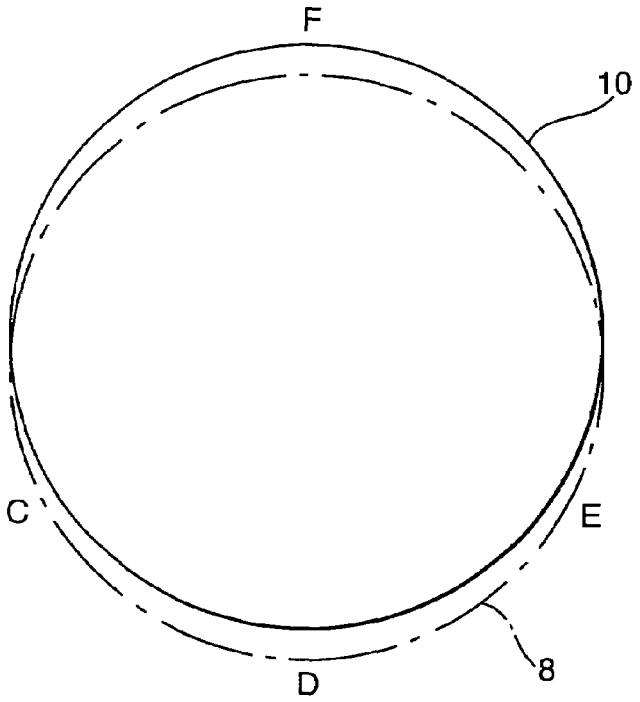
FIG. 6 is an axial view of the prefilmer along arrow Z of FIG. 1.

FIG. 6, is a view of the upstream edge 8 and downstream edge 10 of the swirl slot in the direction of arrow Z of FIG. 1. At point F, at the top half of FIG. 6, which corresponds to FIG. 3, there is a large out-of-wind step that causes a region of low static pressure within the swirl slot.

Figure 7:
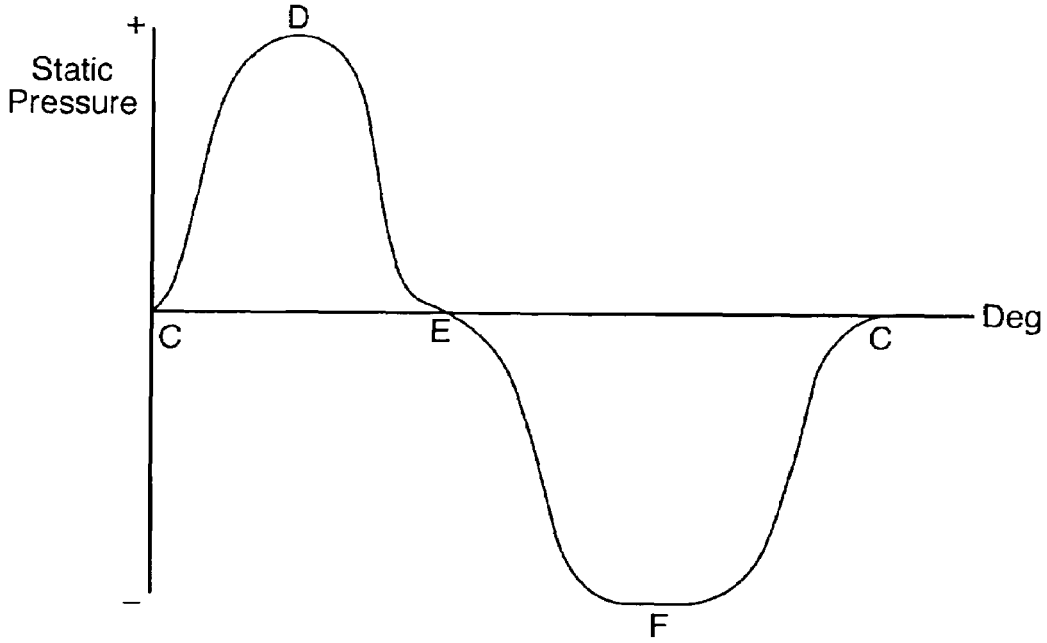
FIG. 7 depicts the static pressure distribution along the swirl slot.

At point D, at the bottom half of FIG. 6, which corresponds to FIG. 4 there is a large into-wind step that causes a region of high static pressure within the swirl slot at that point. A graph of the static pressures around the swirl slots is shown in FIG. 7 It will be noted that in addition to a region of low static pressure F and a region of high static pressure D there are also regions where the static pressure is relatively neutral (C and E).

Fuel is supplied to the swirl slot from a manifold that connects with the swirl slot at a number of locations along the length of the swirl slot. The maximum AP seen by the fuel is the difference between the static pressures in the swirl slot at point F and that at point D.

In normal operation at high power requirements, the pressure of the fuel flowing through the manifolds and into the swirl slot negates the ΔP within the swirl slot that is caused by the various radial changes between the upstream lip and the downstream lip along the length of the swirl slot and ensures that it is insignificant.

When the fuel flow is turned off, at low power conditions, the ΔP within the swirl slot that is caused by the various radial changes between the upstream lip and the downstream lip along the length of the swirl slot ensures that residual fuel within the slot is forced from the region of high static pressure to the region of low static pressure.

By removing the residual fuel from the swirl slot it is possible to prevent coking in the swirl slot. Similarly, the region of low pressure serves to cause fuel to flow from the inwardly extending manifolds 6*a* and into the swirl slot where it is ejected into the combustor. By removing the residual fuel from these manifolds it is possible to prevent coking in the fuel supply.

The injector is structured such that the manifold 6 is sufficiently insulated that its temperature when no fuel is flowing therethrough is below the temperature required to enable coking. In this way, clearing fuel from the inwardly extending manifolds 6*a* is sufficient to prevent coking in the fuel supply system. Additional thermal insulation or cooling of the purge gas may be required to ensure the low temperature is achieved.

In a preferred embodiment fuel is supplied to the swirl slot in two sections fed from a common manifold. The common manifold bifurcates into a first supply passage and a second supply passage, each of which branch to form a number of discrete passages that feed the swirl slot at a number of points along its length.

The first section C-E, through F, is fed by the first supply passage. The second section C-E, through D, is fed by the second supply passage. By feeding fuel in this way and separating the annular passage at the point of neutral static pressure the ΔP seen by the fuel is the difference between the static pressure at point C, or E and that at point F, or the difference between the static pressure at point C, or E and that at point D. Beneficially, this reduced ΔP improves the flow characteristics of the fuel on the prefilmer, especially at low fuel flow—which can occur at low power conditions—when the relative difference in pressure of the fuel and the air flowing on the prefilmer is substantially the same.

In normal operation at high power requirements, the pressure of the fuel flowing through the manifolds and into the swirl slot negates the ΔP within the swirl slot that is caused by the various radial changes between the upstream lip and the downstream lip along the length of the swirl slot and ensures that it is insignificant.

When the fuel flow is turned off, at low power conditions, the ΔP within the swirl slot that is caused by the various radial changes between the upstream lip and the downstream lip along the length of the swirl slot ensures that residual fuel within the slot is forced from the region of high static pressure to the region of low static pressure.

By removing the residual fuel from the swirl slot it is possible to prevent coking in the swirl slot. Similarly, the region of low pressure serves to cause fuel to flow from the inwardly extending manifolds 6*a* and into the swirl slot where it is ejected into the combustor. By removing the residual fuel from these manifolds it is possible to prevent coking in the fuel supply.

Figure 8:
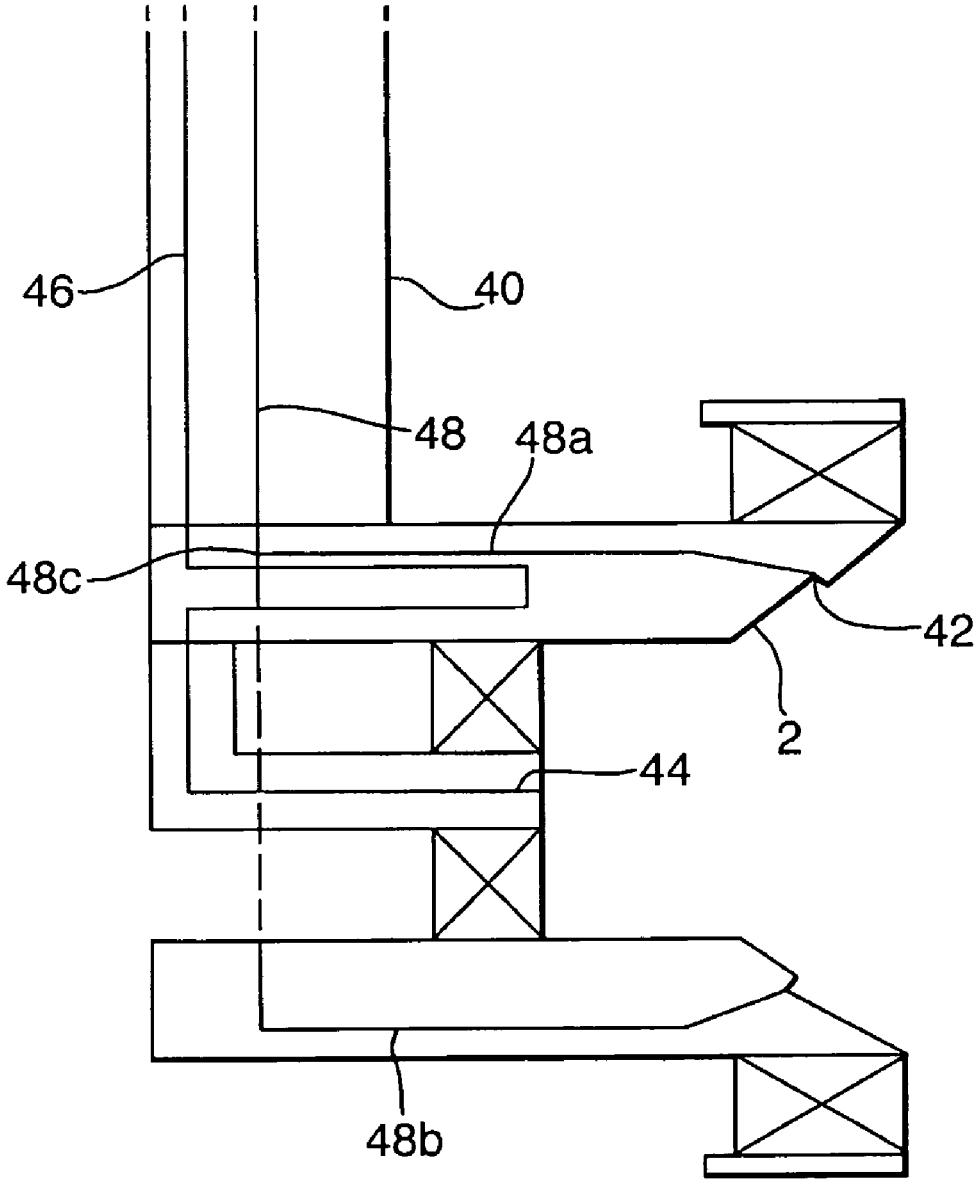
FIG. 8 depicts a schematic of an injector system according to the invention.
Figure 9:
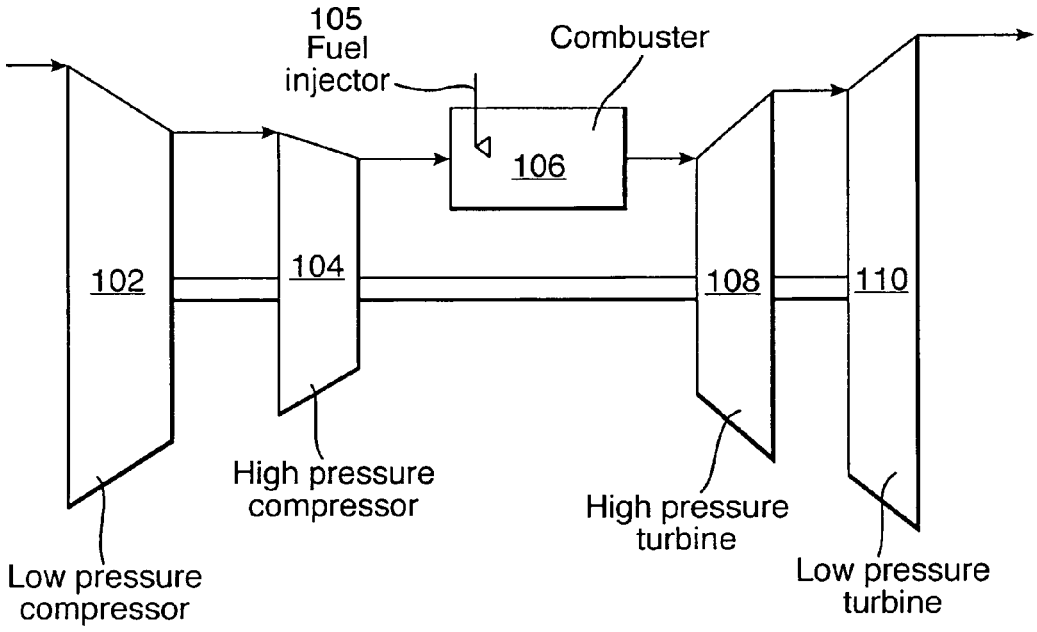
FIG. 9 depicts a gas turbine engine incorporating an injector system according to the invention.

FIG. 8 is a schematic of a fuel injector system where the injector system incorporates a main injector 42 and a pilot injector 44 mounted on the end of a shaft 40. Fuel is supplied to the pilot injector 44 through a conduit 46 that extends along the shaft 40. The conduit is located adjacent a further conduit 48 which supplies fuel to the main injector. Adjacent, in this situation, means the two conduits are close enough such any that residual fuel that remains within the second conduit when the main injector is not operating is cooled by the flow of fuel passing through the conduit that supplies the pilot injector. The presence of just two fuel conduits within the shaft allows the shaft to be easily and cheaply manufactured.

Within the injector head the main fuel conduit divides into two passages. The first passage 48*b* extends to the prefilmer 2 of the airblast injector 42. The prefilmer at the point where the passage terminates is structured to generate a region of high static pressure. The structure is preferably part of an eccentrically machined prefilmer as described earlier.

The second passage 48*b* also terminates at the prefilmer 2 of the airblast injector 42. The prefilmer at the point where this passage terminates is structured to generate a region of static pressure that is relatively lower than the region of static pressure into which the first passage 48*a* terminates.

The point of bifurcation 48*c* is someway remote from the swirl slot and it is possible, with the pressure difference caused by the eccentrically formed upstream lip and downstream lip, to clear fuel downstream from the point of bifurcation i.e. from passages 48*a* and 48*b* when the main injector has been turned off.

To describe the method in more detail, a valve (not shown) controls the supply of fuel to conduit 48. At a time of low power requirement the valve is closed and the fuel remaining in the conduits 48, 48*a* and 48*b* becomes residual fuel.

In normal operation the pressure of the fuel through conduits 48*a* and 48*b* ensures that any difference in flow through the conduits that may be caused by the eccentric machining of the prefilmer is insignificant. However, when the flow through these conduits is interrupted the pressure difference caused by the air flow over the surface of the eccentrically machined prefilmer becomes significant.

The difference in static pressure drives the residual fuel along conduit 48*a* to the point of bifurcation and subsequently along conduit 48*b* where it is expelled into the combustion chamber. Thus, the conduits 48*a* and 48*b* are purged of residual fuel.

At least some residual fuel will remain in the conduit 48 upstream of the point of bifurcation 48*c*. This fuel is subject to coking, but is kept below the temperature at which coking occurs by the positioning of the pilot fuel supply. Since fuel flows through the pilot fuel supply conduit 46 even at times of low engine power requirement the fuel maintains the residual fuel at a temperature below 200° C.

In this way the fuel supply system avoids coking. Beneficially, the purging system is self contained within the injector with the pilot fuel supplies being in minimal thermal contact with the purged and therefore hotter main fuel supply conduits 48*a* and 48*b*. The injector is kept relatively simple and no control valve is required to control heat transfer caused by the hot purge gas.

The into-wind and out-of-wind steps are conveniently formed by eccentric machining of the upstream prefilmer surface and the downstream prefilmer surface. The machining can be performed in a single manufacturing step.

The difference in static pressure within the swirl slot can affect the flow characteristics of the fuel at low flow rates. Beneficially, non-uniform fuel distribution can generate high flame temperatures. The non uniform fuel distribution can also affect the pressure disturbance caused by combustion within the combustor and beneficially this can reduce rumble.

Various modifications may be made without departing from the scope of the invention.

For example, the into-wind step and out-of-wind step may not necessarily be at their maximum at the bottom and top respectively of the injector. Instead, their position may be rotated around the circumference of the injector or even reversed.

Additionally, the upstream lip and downstream lip may not have a sharp angle. A person of skill in the art would understand that a variety of angles or shapes could be used to provide a smaller disturbance to the flow of air along the prefilmer and to provide an alternative pressure difference.

The invention may be used on an airblast injector, a dual injector or a piloted airblast injector.

I claim:

1. A fuel injector for a gas turbine engine, having:

a prefilmer having a first surface and a second surface, the first surface and the second surface being separated by an annular swirl slot for the supply of fuel to the second surface;

wherein the first surface has an annular lip that forms a first edge of the swirl slot and the second surface has an annular lip that forms a second edge of the swirl slot, and the first edge and the second edge are eccentric to each other such that, in use, a flow of fluid over the prefilmer creates a static pressure within the swirl slot that varies over the length of the swirl slot; and wherein the prefilmer extends about an injector axis and the first edge of the swirl slot and the second edge of the swirl slot each extend about a respective but different axis, and at least one of the respective axes is parallel to but not coaxial with, the injector axis.

2. A fuel injector according to claim 1, wherein, in use, the first surface is an upstream surface and the second surface is a downstream surface.

3. A fuel injector according to claim 1 further having a fuel manifold for supplying fuel to the swirl slot.

4. A combustion chamber for a gas turbine engine incorporating the fuel injector according to claim 1.

5. A gas turbine engine incorporating the fuel injector according to claim 1.

6. A fuel injector for a gas turbine engine, having:

a prefilmer having a first surface and a second surface, the first surface and the second surface being separated by an annular swirl slot for the supply of fuel to the second surface;

wherein the circumferential length of the swirl slot is divided into at least two sub-lengths, the location of the first sub-length being disposed in a first region of the injector with respect to an axis of the injector, the location of the second sub-length being disposed in a second region of the injector, opposite the first region, with respect to the axis of the injector, along the first sub-length of the swirl slot the second surface of the prefilmer is located radially inside the first surface, if the first surface was extended axially in a direction of the second surface, beyond the swirl slot and at the same angle relative to an axis of the injector, and along the second sub-length of the swirl slot the second surface of the prefilmer is located radially outside the first surface, if the first surface was extended axially in the direction of the second surface, beyond the swirl slot and at the same angle relative to the axis of the injector, such that in use, a flow of fluid over the prefilmer creates a static pressure within the swirl slot, the static pressure over the first sub-length of the swirl slot being greater than the static pressure over the second sub-length of the swirl slot.

7. A fuel injector according to claim 6, wherein in use, the first surface is an upstream surface and the second surface is a downstream surface.

8. A fuel injector according to claim 6, further having a fuel manifold for supplying fuel to the swirl slot.

9. A fuel injector according to claim 8, wherein the fuel manifold divides to substantially simultaneously supply fuel to the first sub-length and the second sub-length of the swirl slot under the condition that fuel is being supplied to the downstream surface of the prefilmer.

10. A combustion chamber for a gas turbine engine incorporating a fuel injection system according to claim 6.

11. A gas turbine engine incorporating the fuel injector according to claim 6.

* * * * *